US005436641A

United States Patent [19]

Hoang et al.

[11] Patent Number: 5,436,641

[45] Date of Patent: Jul. 25, 1995

[54] FLEXIBLE GRAPHICS INTERFACE FOR MULTIPLE DISPLAY MODES

[75] Inventors: Thuan T. Hoang, Santa Clara; Rajan N. Kapur, Fremont; William W. Y. Chu, Los Altos, all of Calif.

[73] Assignee: Cirrus Logic, Inc., Fremont, Calif.

[21] Appl. No.: 205,887

[22] Filed: Mar. 3, 1994

[51] Int. Cl.[6] ..... G09G 1/02

[52] U.S. Cl. ..... 345/197; 345/201; 348/596

[58] Field of Search ..... 345/133, 198, 201, 132, 345/150, 197; 348/596, 593, 578; 365/230.05; 395/131

[56] References Cited

U.S. PATENT DOCUMENTS

| | | | |
|---|---|---|---|
| 5,027,212 | 6/1991 | Marlton et al. | 345/133 |
| 5,083,119 | 1/1992 | Trevett et al. | 345/201 |
| 5,115,314 | 5/1992 | Ross et al. | 345/196 |
| 5,150,109 | 9/1992 | Berry | 345/132 |
| 5,206,833 | 4/1993 | Lee | 345/150 |
| 5,227,863 | 7/1993 | Bilbrey et al. | 348/578 |
| 5,257,237 | 10/1993 | Aranda et al. | 365/230.05 |
| 5,289,565 | 2/1994 | Smith et al. | 395/131 |

*Primary Examiner*—Ulysses Weldon

*Attorney, Agent, or Firm*—Blakely, Sokoloff, Taylor & Zafman

[57] ABSTRACT

A graphics interface circuit for connecting a serial output port of a video RAM to a RAMDAC to allow a user selectable color mode to be displayed wherein the selectable color modes allows one of 256, 32K, 64K or 16.7M colors to be displayed at one time. A host microprocessor addresses the video RAM as a linear, unfragmented address space in the selected one of these modes. The invention provides an improved utilization of the video RAM memory space, as well as improved memory bandwidth as compared with prior art techniques. A graphics interface module allows for 8, 16, 24 or 32 bit wide output on the data bus from the interface to a RAMDAC. A display system of the type in which the present invention may be utilized places data generated by a host processor, after processing by a graphic displays processor into a video memory. The display processor constantly updates the video memory based upon the data generated by the host processor. The data in the video memory is transferred to a graphics interface which receives the data from the video memory and passes it to the RAMDAC which converts the digitized data into analog signals capable of being displayed by a display.

9 Claims, 6 Drawing Sheets

FLEXIBLE GRAPHICS INTERFACE FOR MULTIPLE DISPLAY MODES

BACKGROUND OF THE INVENTION

Random access memory digital-to-analog converters (RAMDAC) are devices which receive digitized video data from a video random access memory (VRAM) and convert the digitized data to an analog signal suitable for use by a display monitor for displaying the video data. In order to support multiple bus widths and multiple bits per pixel depths, a graphics interface is placed between the VRAM and the RAMDAC. The graphics interface receives data from the VRAM and, under control of a graphics display processor, provides an interface between the VRAM and RAMDAC. Typically, prior an graphics interfaces provide only a limited set of bus width and pixel depth options. One such prior art interface is the TVP3020 sold by Texas Instruments. This interface is limited to a 64 bit serial bus connecting to the VRAM and has pixel depths of 16 and 32 bits. The prior an also cannot access the VRAM in banks resulting in less efficient use of the VRAM space.

BRIEF SUMMARY OF THE INVENTION

The present invention is directed to a graphics interface circuit for connecting a serial output port of a video RAM to a RAMDAC to allow a user selectable color mode to be displayed wherein the selectable color modes allows one of 256, 32K, 64K or 16.7M colors to be displayed at one time. A host microprocessor addresses the video RAM as a linear, unfragmented address space in the selected one of these modes. The invention provides an improved utilization of the video RAM memory space, as well as improved memory bandwidth as compared with prior art techniques. The invention, by virtue of a flexible interleave multiplexor, provides a flexible interleave scheme which provides support for the four graphics modes specified above.

A display system of the type in which the present invention may be utilized places data generated by a host processor, after processing,by a graphic displays processor into a video memory. The display processor constantly updates the video memory based upon the data generated by the host processor. The data in the video memory is transferred to the graphics interface which receives the data from the video memory and passes it to the RAMDAC which converts the digitized data into analog signals capable of being displayed by a display.

DETAILED DESCRIPTION OF THE INVENTION

Figure 1:
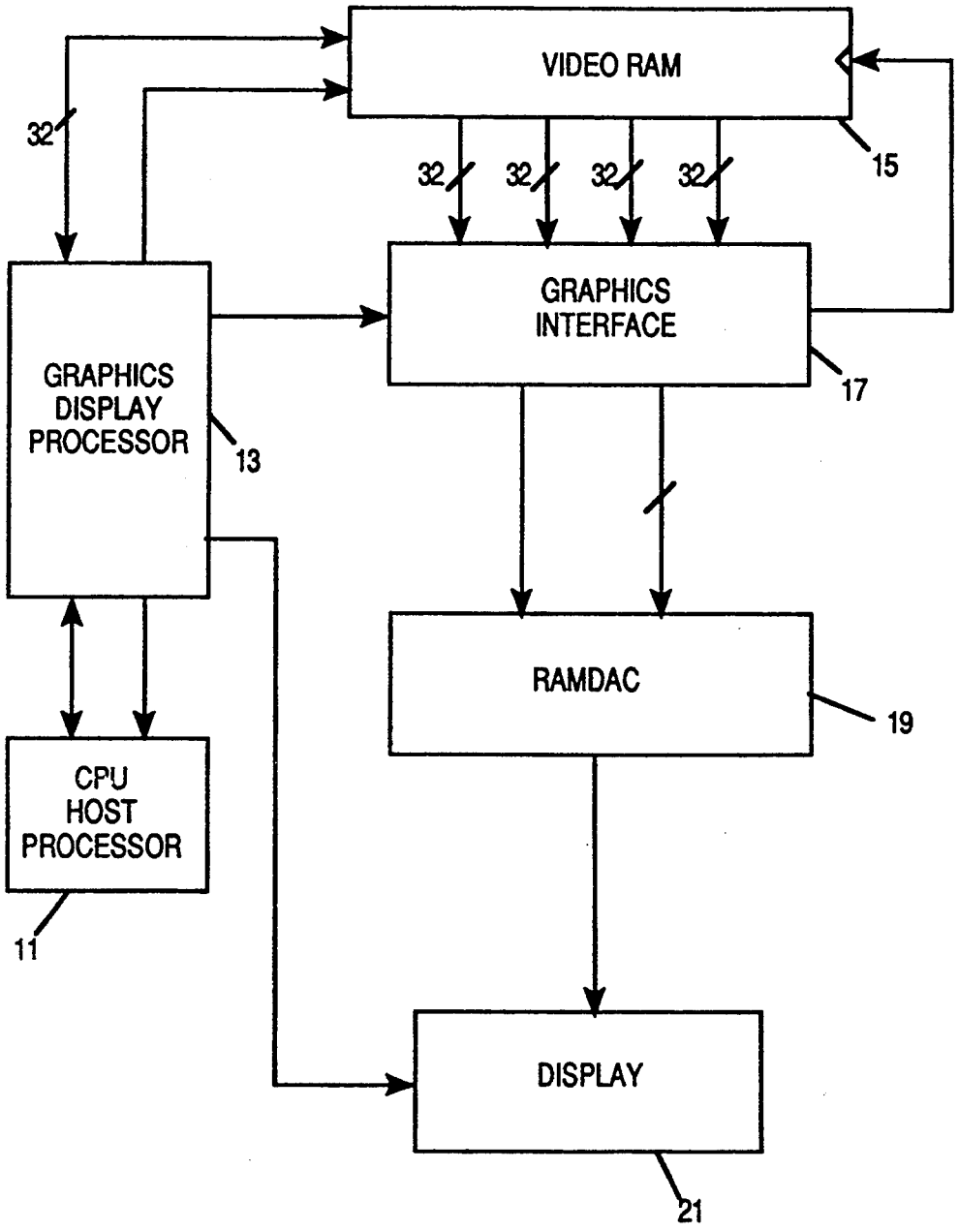
FIG. 1 is a block overview diagram showing a system in which the present invention may be utilized.

FIG. 1 is a block overview showing a graphics display system in which the present invention may be utilized. The display system comprises a host processor with CPU 11, graphics display processor 13, video memory 15, graphics interface 17, RAMDAC 19 and display 21. The invention lies in the graphics interface module which allows for 8, 16, 24 or 32 bit wide output on the data bus from the interface to RAMDAC 19. In the prior art, circuitry performing the function of graphics interface 17 usually is able to output only one of 8, 16 or 32 bit wide output to the RAMDAC. Although some sophisticated graphics interfaces are capable of operating in a 24 bit wide mode, such prior an graphics interfaces require three graphics display processors, and three different sets of video memory to operate in 24 bit wide mode.

In general, a display system of the type in which the present invention may be utilized places data generated by host processor 11, after processing by graphic displays processor 13, into a video memory 15. The display processor constantly updates the video memory based upon the data generated by the host processor 11. The data in video memory 15 is transferred to a graphics interface 17 which receives the data from the video memory and passes it to RAMDAC 19 which converts the digitized data into analog signals capable of being displayed by a display 21. As previously noted, in the prior art, the capabilities of the graphics interface are limited in that prior art graphics interfaces are capable of handling only a relatively small number of display modes as compared with the graphics interface of the present invention.

Figure 2:
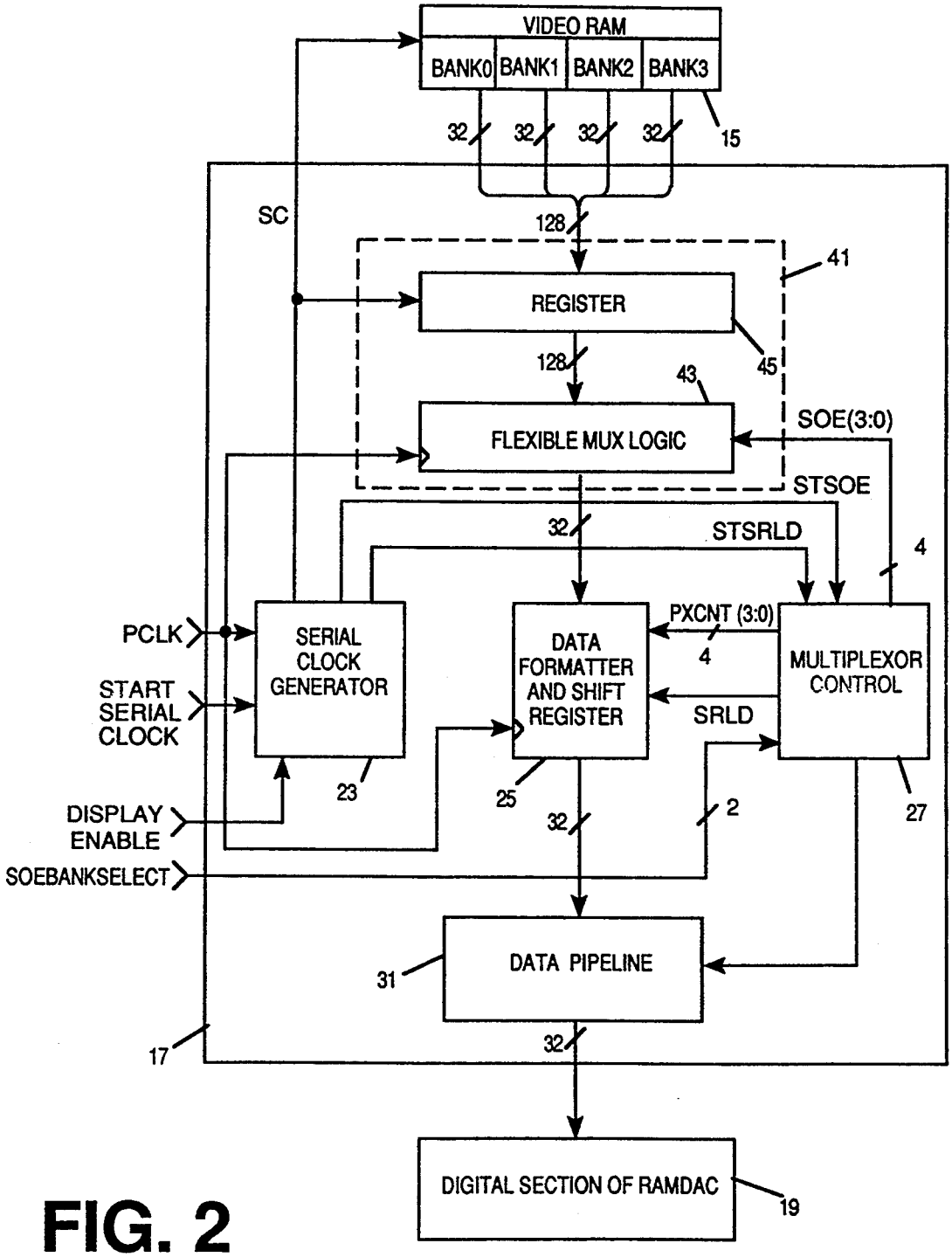
FIG. 2 is a block diagram showing an implementation of the invented graphics interface.

FIG. 2 is a block diagram of the elements of a graphics interface 17 according to the present invention. The interface comprises a flexible interleave multiplexor 41 utilizing flexible multiplexor logic 43 and a register 45, serial clock generator 23, data formatter and shift register 25, multiplexor control 27 and data pipeline 31. Video RAM 15 shown in FIG. 2 is a standard video RAM, e.g. a 256K*4 or 256K*8 or 256K*16 VRAM which stores video information to be displayed on a display 21 (not shown in FIG. 2). The video RAM is connected to the graphics interface 17 by a 32, 64, 96 or 128-bit serial bus, depending on total video memory installed with FIG. 2 showing the connection by a 128-bit serial bus. One bank (1 MByte), two banks (2 MBytes), three banks (3 Mbytes) or four banks (4 Mbytes) of video RAM will provide a 32, 64, 96, or 128-bit serial bus to graphics interface 17 respectively, the operation and implementation details of which are well known to persons skilled in the field of the invention.

The invention, by virtue of the flexible interleave multiplexor 41, provides a flexible interleave scheme which provides support for the graphics modes shown in Table I which shows interleave ratio as a function of the maximum number of colors which can be simultaneously displayed versus the size of the serial bus.

TABLE I

INTERLEAVE RATIO TABLE

| SERIAL BUS | MAX. NO. OF COLORS DISPLAYED AT A GIVEN TIME | | | |
|---|---|---|---|---|
| | 256 | 32K/64K | 16.7M | 16.7M w/alpha |
| 32-bit (4 bytes) | 4:1 | 4:2 | 4:3 | 4:4 |
| 64-bit (8 bytes) | 8:1 | 8:2 | 8:3 | 8:4 |
| 96-bit (12 bytes) | 12:1 | 12:2 | 12:3 | 12:4 |
| 128-bit (16 bytes) | 16:1 | 16:2 | 16:3 | 16:4 |

Eight bits per pixel (bitpp), 16 bitpp, 24 bitpp and 32 bitpp represent 256 colors, 32K/64K colors, 16 Million colors and 16 Million colors with alpha overlay respectively.

It should be noted that prior art graphics interfaces can display 256, 32K/64K or 16.7M w/alpha colors at one time with 32 bit and 64 bit serial buses at the interleave ratios shown in Table I. However, the present invention provides a mechanism for utilizing 96 bit and 128 bit serial buses as well as for displaying 16.7M colors at 4:3, 8:3, 12:3 and 16:3 interleave ratios. In this manner, the present invention provides a more efficient use of video RAM since 16.7M colors can be displayed using a smaller interleave ratio than that which is required by prior an graphics interfaces.

The invention also supports the resolutions and frequencies shown in Table II.

TABLE II

| Resolution | No. of Bits per Pixel | Pixel Clock | Vertical. Ref. Clock |
|---|---|---|---|
| 640×480 | 8 | 32 MHz | 73 Hz |
| 640×480 | 16 | 32 MHz | 73 Hz |
| 640×480 | 24 | 32 MHz | 73 Hz |
| 640×480 | 32 | 32 MHz | 73 Hz |
| 800×600 | 8, 16, 24, 32 | 50 MHz | 73 Hz |
| 1024×768 | 8, 16, 24, 32 | 85 MHz | 73 Hz |
| 1280×1024 | 8, 16, 24, 32 | 135 MHz | 73 Hz |

The inputs to serial clock generator 23 are the signals pixel clock (PCLK), start serial clock (STSC), and display enable (DISPE). Pixel clock is a clock signal generated by graphics processor 13 having a frequency of 32 MHz, 50 MHz, 85 MHz or 135 MHz depending on the resolution of the display being utilized as shown in Table II. The signal start serial clock is a signal generated by the graphics processor at a relative timing with respect to the display enable signal. The display enable (DISPE) signal is generated by the graphics processor when the video appears on the monitor. This DISPE signal is the composite of the vertical display enable and horizontal display enable signals. It is generated by a pair of counters and comparators. Basically, it tells the graphics interface when to display the first scanline and other scanlines and when to display pixels of each scanline. The specific details of its generation are well known to persons skilled in the art.

Figure 3A:
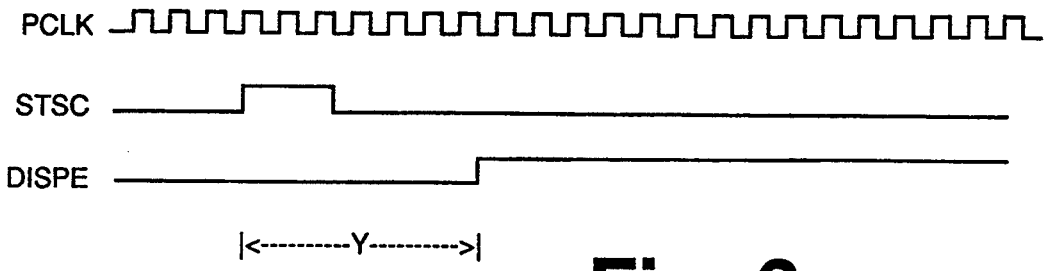
FIG. 3*a* is a diagram showing the timing relationships between the signals pixel clock (PCLK), start serial clock (STSC) and display enable (DISPE).

Table III and FIG. 3*a* describe the relationship between the signals start serial clock and display enable, i.e., the number of pixel clock cycles (Y) between the rising edge of the start serial clock and the rising edge of display enable (see FIG. 3*a*).

TABLE III

| Bank No. | No. of Bits per Pixel | Y (in terms of pixel clocks) |
|---|---|---|
| 1 | 8 | 9 |
| 1 | 16 | 5 |
| 1 | 24 | 3 |
| 1 | 32 | 3 |
| 2 | 8 | 13 |
| 2 | 16 | 7 |
| 2 | 24 | 4 |
| 2 | 32 | 4 |
| 3 | 8 | 17 |
| 3 | 16 | 9 |
| 3 | 24 | 6 |
| 3 | 32 | 5 |
| 4 | 8 | 21 |
| 4 | 16 | 11 |
| 4 | 24 | 6 |
| 4 | 32 | 6 |

Serial clock generator 23 generates three clock signals, one of which (SC) is input to video RAM 15 and two of which (STSOE and STSRLD) are input to multiplexor control 27. The SC or shift clock signal input to video RAM 15 is generated from the pixel clock signal as shown in Table IV.

TABLE IV

| No. of banks | No. of Bits per Pixel | SC (shift clock) derived from PCLK (pixel clock) |
|---|---|---|
| 1 | 8 | 2 PCLK high, 2 PCLK low, then repeat |
| 1 | 16 | 1 PCLK high, 1 PCLK low, then repeat |
| 1 | 24 | 0.5 PCLK high, 0.5 PCLK low, 0.5 PCLK high, 0.5 PCLK low, 0.5 PCLK high, 1.5 PCLK low, then repeat |
| 1 | 32 | same as PCLK |
| 2 | 8 | 4 PCLK high, 4 PCLK low, then repeat |
| 2 | 16 | 2 PCLK high, 2 PCLK low, then repeat |
| 2 | 24 | 1 PCLK high, 1 PCLK low, 1 PCLK high, 2 PCLK low, 1 PCLK high, 2 PCLK low then repeat |
| 2 | 32 | 1 PCLK high, 1 PCLK low, then repeat |
| 3 | 8 | 6 PCLK high, 6 PCLK low, then repeat |
| 3 | 16 | 3 PCLK high, 3 PCLK low, then repeat |
| 3 | 24 | 2 PCLK high, 2 PCLK low, then repeat |
| 3 | 32 | 1 PCLK high, 2 PCLK low, then repeat |
| 4 | 8 | 8 PCLK high, 8 PCLK low, then repeat |
| 4 | 16 | 4 PCLK high, 4 PCLK low, then repeat |
| 4 | 24 | 2 PCLK high, 3 PCLK low, 2 PCLK high, 3 PCLK low, 3 PCLK high, 3 PCLK low, then repeat |
| 4 | 32 | 2 PCLK high, 2 PCLK low, then repeat |

The two inputs to multiplexor control 27 from serial clock generator 23 are start shift load (STSRLD), and start select MUX (STSOE). The serial clock generator 23 is a complex state machine used to generate the SC (shift clock) signal which is described in Table IV. The SC signal starts to toggle when the serial clock generator 23 detects the STSC (start serial clock) signal. The SC signal continues as described in Table IV. The SC signal terminates when the falling edge of the DISPE (display enable) signal is detected.

The serial clock generator 23 also generates the STSOE and STSRLD signals. The STSOE signal tells multiplexor control 27 when to toggle the SOE0, SOE1, SOE2, SOE3 signals. The STSRLD signal tells multiplexor control 27 when to start loading data from flexible multiplexor 41 to data formatter and shift register 25. There is a relationship between the STSC and STSOE signals which is shown in FIG. 3*b*.

Figure 3B:
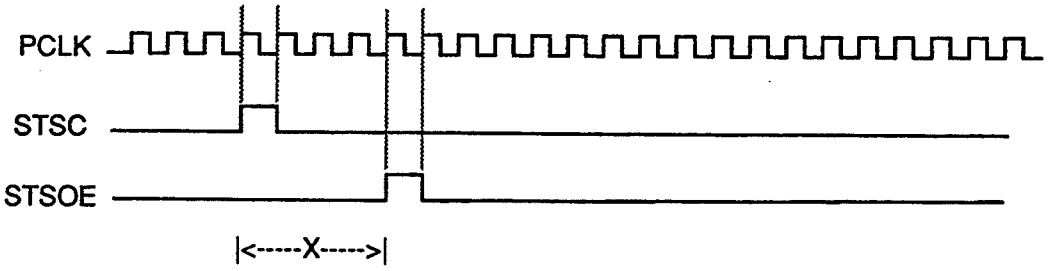
FIG. 3*b* is a diagram showing the timing relationships between the-signals pixel clock (PCLK), start serial clock (STSC) and start select MUX (STSOE).

Table V and FIG. 3*b* describe the relationship between the STSC and STSOE signals.

TABLE V

| Bank No. | No. of Bits per Pixel | X (in terms of pixel clocks) |
|---|---|---|
| 1 | 8 | 01 |
| 1 | 16 | 01 |
| 1 | 24 | 01 |
| 1 | 32 | 01 |
| 2 | 8 | 8 |
| 2 | 16 | 4 |
| 2 | 24 | 2 |
| 2 | 32 | 2 |
| 3 | 8 | 12 |
| 3 | 16 | 6 |
| 3 | 24 | 4 |
| 3 | 32 | 3 |
| 4 | 8 | 16 |
| 4 | 16 | 8 |
| 4 | 24 | 4 |
| 4 | 32 | 4 |

Figure 3C:
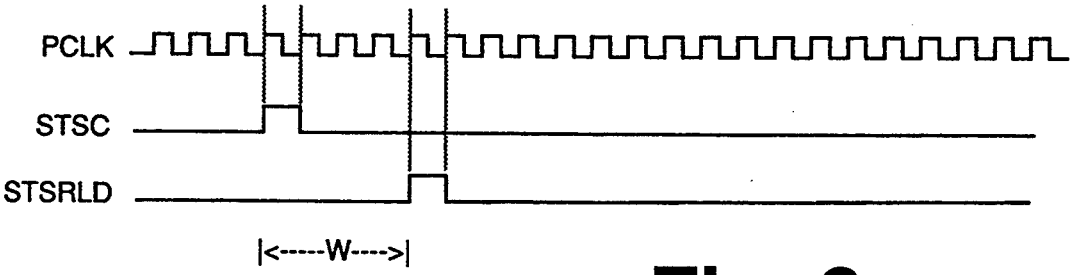
FIG. 3*c* is a diagram showing the timing relationships between the signals pixel clock (PCLK), start serial clock (STSC) and start shift load (STSRLD).

Table VI and FIG. 3*c* describe the relationship between the STSC and STSRLD signals.

TABLE VI

| Bank No. | No. of Bits per Pixel | W (in terms of pixel clocks) |
|---|---|---|
| 1 | 8 | 7 |
| 1 | 16 | 3 |
| 1 | 24 | 1 |
| 1 | 32 | 1 |
| 2 | 8 | 11 |
| 2 | 16 | 5 |
| 2 | 24 | 2 |
| 2 | 32 | 2 |
| 3 | 8 | 15 |
| 3 | 16 | 7 |
| 3 | 24 | 4 |
| 3 | 32 | 3 |
| 4 | 8 | 19 |
| 4 | 16 | 9 |
| 4 | 24 | 4 |
| 4 | 32 | 4 |

Figure 4:
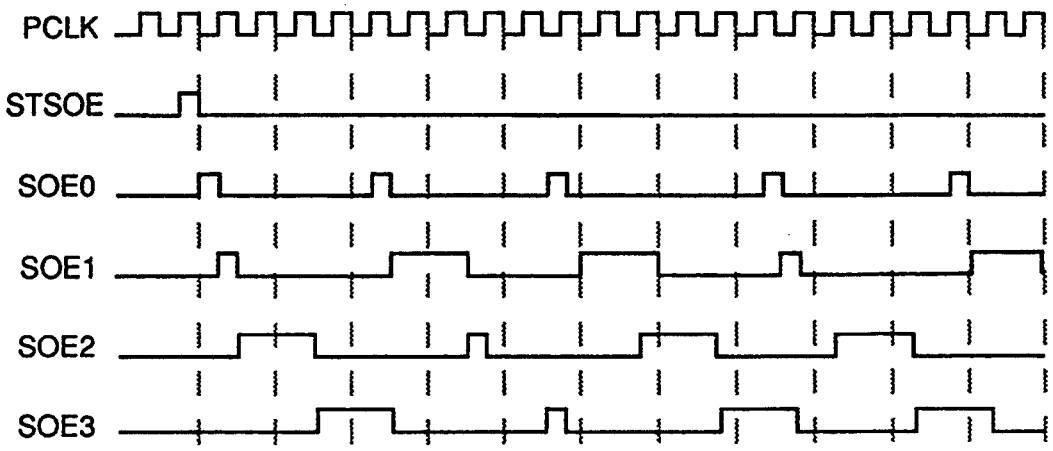
FIG. 4 is a diagram showing timing relationships between the signals PCLK, STSOE, SOE0, SOE1, SOE2 and SOE3.

Multiplexor control 27 generates shift load (SRLD) and pixel count (PXCNT)<3:0> which are input to data formatter and shift register 25. Details regarding the generation of the SRLD and PXCNT signals are set forth below. The signal inputs to flexible interleave multiplexor 41 from multiplexor control 27 are SOE0, SOE1, SOE2 and SOE3 designated as SOE<3:0>. The SOE<3:0> signals are mutually exclusive. SOE0, SOE1, SOE2, SOE3 are generated from STSOE. SOE0, SOE1, SOE2, and SOE3 and select 32-bit data from VRAM 15 bank 0, 1, 2, and 3 respectively. The SOE0, SOE1, SOE2, and SOE3 signals are very complicated, especially in 24 bit-per-pixel mode. For example, in the 4-bank (128 serial inputs), 8 bit-per-pixel mode, SOE<3:0> is asserted every 4 clocks alternately. But in the 4-bank, 24 bit-per-pixel mode, the signals SOE0, SOE1, SOE2 and SOE3 have the timings shown in FIG. 4 relative to the PCLK and STSOE signals.

There are typically more than 12 different waveforms for each SOE signal, because the invention supports 4 banks, and each bank supports 4 modes (8,16,24 and 32 bit-per-pixel). An implementation of the invention also supports 4 bit-per-pixel mode, but since the details of such implementation are not needed for an understanding of the invention, and should be readily apparent to persons skilled in the art, the specific details of such implementation are not set forth herein.

Tables VII, VIII, IX and X describe how the SOE0 signal is generated from the STSOE signal and how the SOE0, SOE1, SOE2 and SOE3 signals relate to each other.

TABLE VII

| No. of Banks | No. of Bits per Pixel | SOE0 Derived from STSOE |
|---|---|---|
| 1 | 8 | always high |
| 1 | 16 | always high |
| 1 | 24 | always high |
| 1 | 32 | always high |
| 2 | 8 | 4 PCLK high, 4 PCLK low, then repeat |
| 2 | 16 | 2 PCLK high, 2 PCLK low, then repeat |
| 2 | 24 | 1 PCLK high, 1 PCLK low, |
| | | 1 PCLK high, 2 PCLK low, |
| | | 1 PCLK high, 2 PCLK low then repeat |
| 2 | 32 | 1 PCLK high, 1 PCLK low, then repeat |
| 3 | 8 | 3 PCLK high, 9 PCLK low, then repeat |
| 3 | 16 | 2 PCLK high, 4 PCLK low, then repeat |
| 3 | 24 | 1 PCLK high, 3 PCLK low, then repeat |
| 3 | 32 | 1 PCLK high, 2 PCLK low, then repeat |
| 4 | .8 | 4 PCLK high, 12 PCLK low, then repeat |
| 4 | 16 | 2 PCLK high, 6 PCLK low, then repeat |
| 4 | 24 | 1 PCLK high, 4 PCLK low, |
| | | 1 PCLK high, 4 PCLK low, |
| | | 1 PCLK high, 5 PCLK low, then repeat |
| 4 | 32 | 1 PCLK high, 3 PCLK low, then repeat |

TABLE VIII

| No. of Banks | No. of Bits per Pixel | SOE1 derived from SOE0 |
|---|---|---|
| 1 | 8 | always low |
| 1 | 16 | always low |
| 1 | 24 | always low |
| 1 | 32 | always low |
| 2 | 8 | 4 PCLK high, 4 PCLK low, then repeat |
| 2 | 16 | 2 PCLK high, 2 PCLK low, then repeat |
| 2 | 24 | 1 PCLK high, 1 PCLK low, |
| | | 2 PCLK high, 1 PCLK low, |
| | | 2 PCLK high, 1 PCLK low then repeat |
| 2 | 32 | 1 PCLK high, 1 PCLK low, then repeat |
| 3 | 8 | 3 PCLK high, 9 PCLK low, then repeat |
| 3 | 16 | 2 PCLK high, 4 PCLK low, then repeat |
| 3 | 24 | 1 PCLK high, 3 PCLK low, then repeat |
| 3 | 32 | 1 PCLK high, 2 PCLK low, then repeat |
| 4 | 8 | 4 PCLK high, 12 PCLK low, then repeat |
| 4 | 16 | 2 PCLK high, 6 PCLK low, then repeat |
| 4 | 24 | 1 PCLK high, 4 PCLK low, |
| | | 2 PCLK high, 3 PCLK low, |
| | | 2 PCLK high, 4 PCLK low, then repeat |
| 4 | 32 | 1 PCLK high, 3 PCLK low, then repeat |

TABLE IX

| No. of Banks | No. of Bits per Pixel | SOE2 derived from SOE1 |
|---|---|---|
| 1 | 8 | always low |
| 1 | 16 | always low |
| 1 | 24 | always low |
| 1 | 32 | always low |
| 2 | 8 | always low |
| 2 | 16 | always low |
| 2 | 24 | always low |
| 2 | 32 | always low |
| 3 | 8 | 3 PCLK high, 9 PCLK low, then repeat |
| 3 | 16 | 2 PCLK high, 4 PCLK low, then repeat |
| 3 | 24 | 2 PCLK high, 2 PCLK low, then repeat |
| 3 | 32 | 1 PCLK high, 2 PCLK low, then repeat |
| 4 | 8 | 4 PCLK high, 12 PCLK low, then repeat |
| 4 | 16 | 2 PCLK high, 6 PCLK low, then repeat |
| 4 | 24 | 2 PCLK high, 4 PCLK low, |
| | | 1 PCLK high, 4 PCLK low, |
| | | 2 PCLK high, 3 PCLK low, then repeat |
| 4 | 32 | 1 PCLK high, 3 PCLK low, then repeat |

TABLE X

| No. of Banks | No. of Bits per Pixel | SOE3 derived from SOE2 |
|---|---|---|
| 1 | 8 | always low |
| 1 | 16 | always low |
| 1 | 24 | always low |
| 1 | 32 | always low |
| 2 | 8 | always low |
| 2 | 16 | always low |
| 2 | 24 | always low |
| 2 | 32 | always low |
| 3 | 8 | always low |
| 3 | 16 | always low |
| 3 | 24 | always low |
| 3 | 32 | always low |
| 4 | 8 | 4 PCLK high, 12 PCLK low, then repeat |
| 4 | 16 | 2 PCLK high, 6 PCLK low, then repeat |
| 4 | 24 | 2 PCLK high, 4 PCLK low,<br>1 PCLK high, 4 PCLK low,<br>2 PCLK high, 3 PCLK low, then repeat |
| 4 | 32 | 1 PCLK high, 3 PCLK low, then repeat |

Data pipeline 31 operates as a data buffer to RAMDAC 19 and may be implemented as a 32-bit register.

As previously noted, the inputs to serial clock generator 23 are pixel clock (PCLK), start serial clock (STSC) and display enable (DISPE). The relationship between the STSC and DISPE signals have been described above. The details regarding the generation of the signals PCLK, STSC and DISPE by a graphics display processor are well known to persons skilled in the field of the invention and, therefore, are not set forth herein.

Multiplexor control 27 generates the 4-bit pixel count (PXCNT<3:0>) as one input to data formatter and shift register 25. Pixel count is generated in the 24 bit-per-pixel mode only. A circular counter is used to generate these 4 signals counting 1, 2, 4, 8 then repeating from 1 each PCLK. The circular counter is reset when it is not in 24 bit-per-pixel mode or when the display enable signal is inactive.

Multiplexor control 27 also generates the shift and register load control signal (SRLD) as another input to data formatter and shift register 25. The signal SRLD is generated as shown in Table XI.

TABLE XI

| No. of Bits per Pixel | SRLD |
|---|---|
| 8 | 1 PCLK, 3 PCLK low, then repeat |
| 16 | 1 PCLK high, 1 PCLK low, then repeat |
| 24 | always high |
| 32 | always high |

Multiplexor control 27 also generates the four bit serial output enable (SOE<3:0>) signal which is input to flexible MUX logic 43. A detailed description of the SOE<3:0> signals has been described above with reference to Tables VII–X. As previously noted, serial clock generator generates the shift clock (SC) signal which is used to control the loading of register 45 from video RAM 15. A derailed description of the generation of the SC signal by serial clock generator 23 has been set forth above with reference to Table IV.

Flexible MUX logic 43 receives 128 bit wide data from register 45 and selects one of four 32 bit wide pieces of data corresponding to one of four 32 bit wide pieces of data from bank 1 to bank 4 of video RAM 15 depending on the value of SOE which cycles between 0, 1, 2 and 3 as noted above to select a corresponding one of the 32 bit wide pieces of data.

Figure 5:
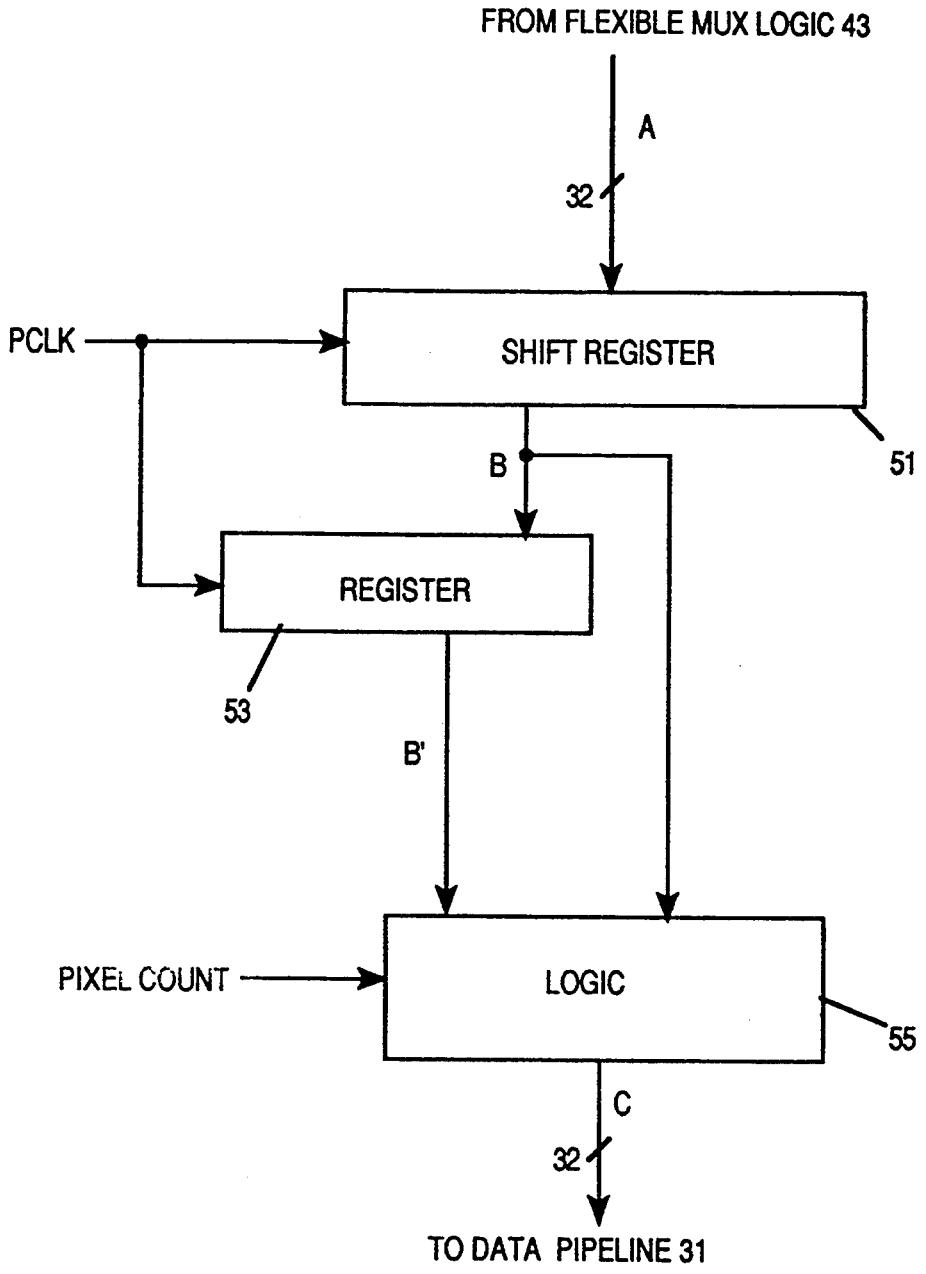
FIG. 5 is a block diagram of data formatter and shift register 25.

Referring now to FIG. 5, data formatter and shift register 25 will now be described. Shift register 51 receives 32 bit data from flexible MUX logic 43. This data is passed to another register 53 and logic 55 each PCLK. Logic 55 operates on the data from register 51 and register 53, which are delayed by one PCLK, and PXCNT<3:0> as follows.

Assuming B<31:0> is the output of shift register 51, and B'<31:0> is output of register 53, and finally C<31:0> is the output of logic 55, logic 55 may be implemented so that it performs the following logic operations:

If not 24 bit-per-pixel mode then

C<31:0>=B<31:0>

If 24 bit-per-pixel mode then

| | | | | |
|---|---|---|---|---|
| C<31:24> = 0; | | | | |
| C<23:16> = | (B<23:16> | AND | PXCNT<0>) | OR |
| | (B<15:8> | AND | PXCNT<1>) | OR |
| | (B<7:0> | AND | PXCNT<2>) | OR |
| | (B'<31:24> | AND | PXCNT<3>); | |
| C<15:8> = | (B<15:8> | AND | PXCNT<0>) | OR |
| | (B<7:0> | AND | PXCNT<1>) | OR |
| | (B'<31:24> | AND | PXCNT<2>) | OR |
| | (B'<23:16> | AND | PXCNT<3>); | |
| C<7:0> = | (B<7:0> | AND | PXCNT<0>) | OR |
| | (B'<31:24> | AND | PXCNT<1>) | OR |
| | (B'<23:16> | AND | PXCNT<2>) | OR |
| | (B'<15:8> | AND | PXCNT<3>). | |

Referring back to FIG. 2, the 32 bits of data output from logic 55 are input to data pipeline 31 which acts as buffer to the digital section of RAMDAC 19.

Figure 6:
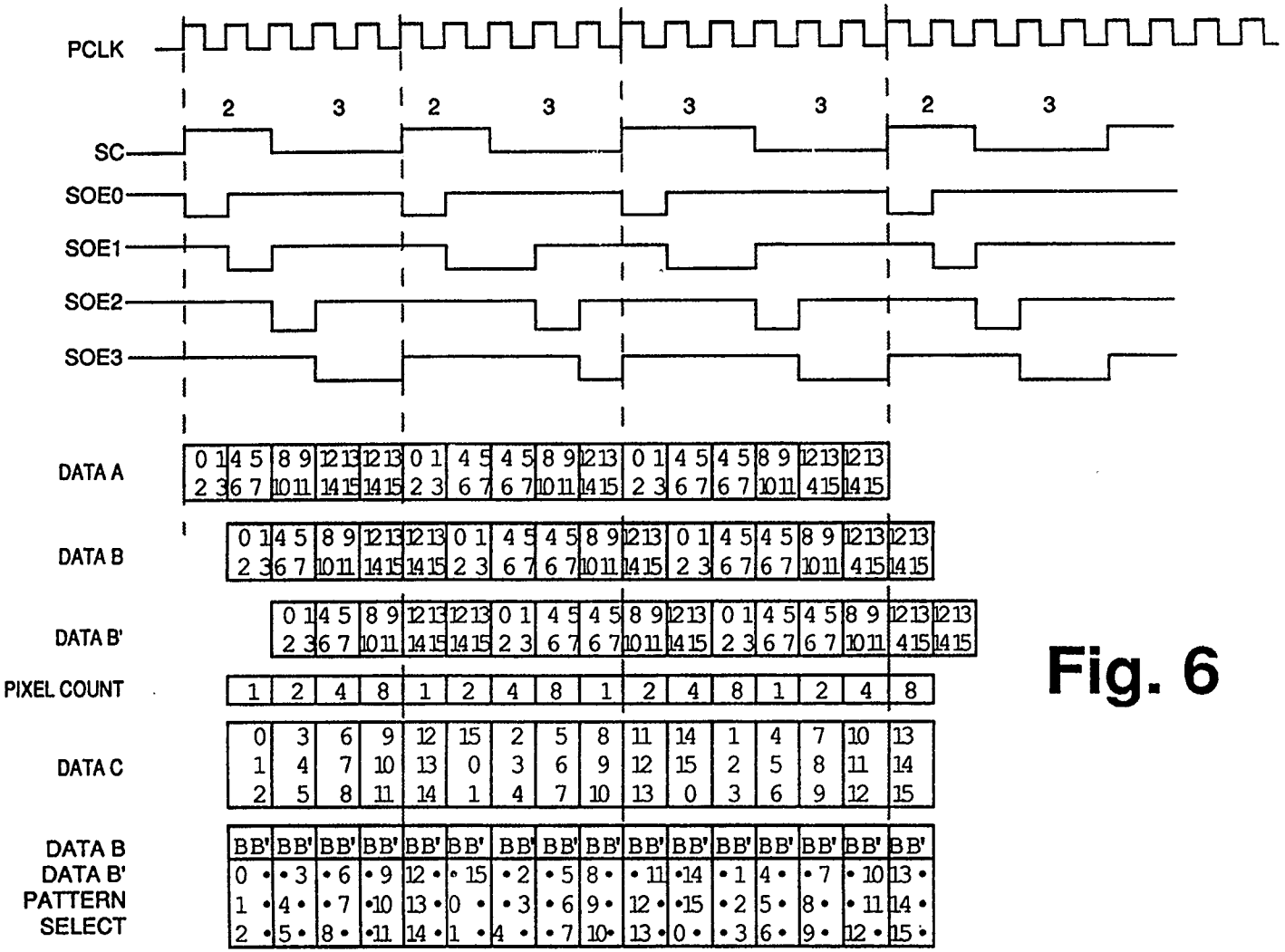
FIG. 6 is a timing diagram showing the relationships between the various clocks and control signals utilized in the invention for flexible MUX logic 43 and data formatter 25 for a color mode having 16.7M colors and ratio of 16:3

FIG. 6 is a timing diagram showing the relationships between the various clocks and control signals utilized in the invention for flexible MUX logic 43 and data formatter 25 for a color mode having 16.7M colors and ratio of 16:3 in 4 bank, 24-bit per pixel mode.

In FIG. 6, the pixel clock PCLK, the shift clock SC, the SOE0, SOE1, SOE2, and SOE3 signals are used to select 32-bit source, data A from flexible MUX logic 43, data B from shift register 51 delayed by one PCLK from data A, data B' from register 53 delayed by one PCLK from data B', and finally data C output from logic 55 as a function of pixel count.

The data from VRAM bank 0 are identified within data A, data B, data B' and data C in FIG. 6 from the least significant byte to the most significant byte as 0, 1, 2, and 3 respectively. The data from VRAM bank 1 are identified from the least significant byte to the most significant byte as 4, 5, 6, and 7 respectively. The data from VRAM bank 2 are identified from the least significant byte to the most significant byte as 8, 9, 10, and 11 respectively. The data from VRAM bank 3 are identified from the least significant byte to the most significant byte as 12, 13, 14, and 15, respectively. In this connection, it should be noted from data B, data B' pattern select that:

when pixel count is 0, data B bytes 0, 1, 2, 12, 13, 14, 8, 9, 10, 4, 5 and 6 form data C;

when pixel count is 1, data B bytes 4, 5, 0, 1, 12, 13, 8, 9 and data B' bytes 3, 15, 11, and 7 form data C;

when pixel count is 2, data B bytes 8, 4, 0, 12 and data B' bytes 6, 7, 2, 3, 14, 15 and 10, 11 form data C;

when pixel count is 3, data B' bytes 9, 10, 11, 5, 6, 7, 1, 2, 3, 13, 14 and 15 form data C.

The invention also provides a mechanism to allow data from the VRAM to be selected from any one of four banks by using the signal SOEBANKSEL<1:0> as shown in FIG. 2. This signal utilizes the least significant two bits of the current scan line address generated by the graphics processor and causes the VRAM banks to be selected as follows.

If the VRAM has only one bank installed, then data is fetched from that bank regardless of the value of SOEBANKSEL<1> and SOEBANKSEL<0>.

If two banks are installed, data is fetched as follows:

| SOEBANKSEL<1> | SOEBANKSEL<0> | First Bank Selected |
|---|---|---|
| 0 | 0 | Bank 0 |
| 0 | 1 | Bank 1 |
| 1 | 0 | Bank 0 |
| 1 | 1 | Bank 1 |

If three banks are installed, data is fetched as follows:

| SOEBANKSEL<1> | SOEBANKSEL<0> | First Bank Selected |
|---|---|---|
| 0 | 0 | Bank 0 |
| 0 | 1 | Bank 1 |
| 1 | 0 | Bank 2 |
| 1 | 1 | undefined |

If four banks are installed, data is fetched as follows:

| SOEBANKSEL<1> | SOEBANKSEL<0> | First Bank Selected |
|---|---|---|
| 0 | 0 | Bank 0 |
| 0 | 1 | Bank 1 |
| 1 | 0 | Bank 2 |
| 1 | 1 | Bank 3 |

We claim:

1. A graphics interface circuit for connecting a serial output port of a video RAM to a RAMDAC to allow a user selectable color mode to be displayed comprising:
   a) a flexible interleave multiplexor coupled to the serial output port of the video RAM;
   b) serial clock generator means coupled to said flexible interleave multiplexor for generating clock signals which are used to control the timing of data loaded into said flexible interleave multiplexor and of data output from said flexible interleave multiplexor;
   c) data formatter and shift register means coupled to said flexible interleave multiplexor for loading data from said flexible interleave multiplexor and operating on said data to form a data stream from said data output as a function of said color mode and a value within a counter; wherein serial clock generator means is further coupled to the data formatter and shift register means for generating clock signal which are used to control the timing of data loaded into the data formatter and shift register means and of data output from the data formatter and shift register means;
   d) multiplexor control means coupled to said flexible interleave multiplexor, said data formatter and shift register means, and said serial clock generator means for generating control signals for use by said flexible interleave multiplexor to determine which one of a predetermined number of banks of data from said video RAM is to be passed to said data formatter and shift register means;
   e) data pipeline means coupled to said data formatter and shift register means and said multiplexor control means for buffering data from data formatter and shift register means to be passed to the RAMDAC.

2. The graphics interface circuit defined by claim 1 wherein said flexible interleave multiplexor selects one of a plurality of banks of memory forming said video RAM based on a predetermined select signal generated by the multiplexer control means.

3. The graphics interface circuit defined by claim 1 wherein said serial clock generator means comprises a clock generator which generates a shift clock, start shift load and start select MUX clock signals based on a predetermined pixel clock signal and a predetermined start serial clock signal.

4. The graphics interface circuit defined by claim 1 wherein said data formatter and shift register means comprises:
   a) a first register for storing data selected by said flexible interleave multiplexor each cycle of a predetermined pixel clock;
   b) a second register coupled to said first register, said second register loading data from said first register each cycle of said predetermined pixel clock;
   c) a circular counter which cycles between the values 1, 2, 4, 8 each cycle of said predetermined pixel clock;
   c) logic means coupled to said first and second registers and said circular counter for performing a predetermined logic operation using the values in said first register, said second register and said circular counter.

5. The graphics interface circuit defined by claim 1 wherein said multiplexor control means comprises a circular counter for generating a pixel count which cycles between the values 1, 2, 4 and 8 and a shift and register load control signal which is provided to said data formatter and shift register means as a function of a predetermined pixel clock signal.

6. The graphics interface circuit defined by claim 1 wherein said data pipeline means comprises a data buffer coupled between said data register and shift register means and a digital section of said RAMDAC.

7. The graphics interface circuit defined by claim 1 wherein said flexible interleave multiplexor initially selects a predetermined one of a plurality of banks of memory forming said video RAM based on a predetermined select signal generated by the multiplexer control means.

8. The graphics interface circuit defined by claim 1 wherein said flexible interleave multiplexor passes data to said RAMDAC at an interleave ratio of 4:3 with a serial bus that is four bytes wide, at an interleave ratio of 8:3 with a serial bus that is eight bytes wide, at an interleave ratio of 12:3 with a serial bus that is twelve bytes wide and at an interleave ratio of 16:3 with a serial bus that is sixteen bytes wide.

9. A method for allowing a user selectable color mode to be displayed utilizing data in a video RAM which is passed to a RAMDAC comprising the steps of:
   a) generating clock signals which are used to control the timing of data loaded into a flexible interleave multiplexor and of data output from said flexible interleave multiplexor;

b) loading data from said flexible interleave multiplexor and operating on said data to form a data stream from said data output as a function of said color mode and a value within a counter;

c) generating control signals for use by said flexible interleave multiplexor to determine which one of a predetermined number of banks of data from said video RAM is to be passed to a data formatter and shift register means;

d) buffering data from data formatter and shift register means to be passed to the RAMDAC for display on a video display.

* * * * *